US008341793B2

(12) United States Patent
Walker et al.

(10) Patent No.: US 8,341,793 B2
(45) Date of Patent: Jan. 1, 2013

(54) APPARATUS FOR CLEANING FLOOR SURFACES

(76) Inventors: Freddie Walker, Columbus, OH (US); Richard K. Oblesbee, Lancaster, OH (US)

( * ) Notice: Subject to any disclaimer, the term of this patent is extended or adjusted under 35 U.S.C. 154(b) by 597 days.

(21) Appl. No.: 12/629,688

(22) Filed: Dec. 2, 2009

(65) Prior Publication Data

US 2010/0071143 A1 Mar. 25, 2010

Related U.S. Application Data

(60) Provisional application No. 61/143,570, filed on Jan. 9, 2009.

(51) Int. Cl.
*A47L 11/12* (2006.01)
*A47L 11/162* (2006.01)

(52) U.S. Cl. ..... 15/98; 15/49.1; 15/52.2; 451/350; 451/351; 451/353

(58) Field of Classification Search ..... 15/49.1, 15/50.1, 50.2, 52.2, 98; 451/350, 351, 353
See application file for complete search history.

(56) References Cited

U.S. PATENT DOCUMENTS

| | | | | |
|---|---|---|---|---|
| 1,224,292 | A * | 5/1917 | Fisker | 15/52.2 |
| 3,657,759 | A * | 4/1972 | Sawyer | 15/98 |
| 5,341,536 | A * | 8/1994 | Hill | 15/98 |
| 5,511,271 | A * | 4/1996 | Shishido et al. | 15/49.1 |
| 5,623,743 | A | 4/1997 | Burgoon et al. | |
| 7,059,004 | B2 | 6/2006 | Mitchell et al. | |
| 7,140,060 | B1 * | 11/2006 | Walker | 15/98 |
| 2006/0150362 | A1 | 7/2006 | Mitchell | |
| 2008/0078041 | A1 | 4/2008 | Mitchel et al. | |

OTHER PUBLICATIONS

Web page printout, url: <<http://penguinwax.co.jp/product/perfectdry/shut.htm>>, Dec. 2, 2009.

* cited by examiner

*Primary Examiner* — Mark Spisich
(74) *Attorney, Agent, or Firm* — Ronald J. Koch

(57) ABSTRACT

A dual mode floor scrubber with a square cleaning pad that can rotate in a first mode to achieve a scrubbing operation away from the walls, and reciprocate longitudinally in a second mode adjacent to a wall to remove the sediment next to the wall and corners.

2 Claims, 7 Drawing Sheets

FIG. 3
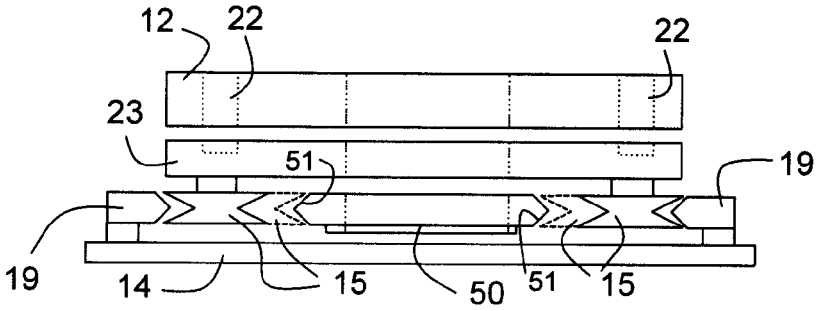
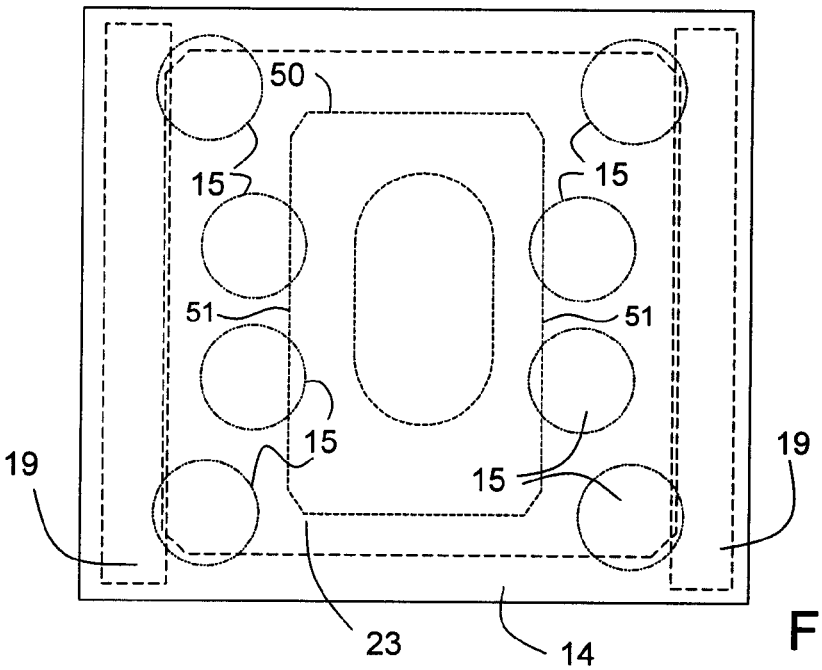
FIG. 4

APPARATUS FOR CLEANING FLOOR SURFACES

The present application is related to the provisional patent application No. 61/143,570 of Freddie Walker, filed 9 Jan. 2009, entitled "Apparatus for Cleaning Floor Surfaces", and based on which priority is herewith claimed under 35 U.S.C. 119(e) and the disclosure of which is incorporated herein by reference in its entirety as if fully rewritten herein.

The present application is related to U.S. Pat. No. 7,140,060, application Ser. No. 11/178,820, filed on Jul. 12, 2005, of Freddie Walker, which is hereby incorporated by reference as if fully re-written herein.

BACKGROUND AND SUMMARY

The present invention relates generally to floor cleaning apparatus and specifically to floor scrubbers and buffers. Conventional floor cleaning schemes require a scrubber having a round scrubbing pad that rotates to remove wax and other unwanted sediment from a floor prior to applying a new coat of wax. Contemporaneous to the scrubbing operation, cleaning personnel must, on hands and knees, proceed along the periphery of a room with a hand held scraper to remove sediment from next to the wall that the round scrubbing pad cannot access. This is problematic in terms of time consumption and/or additional personnel required. The present invention overcomes this disadvantage, as well as achieving other objects and advantages that will be apparent to those of skill in the art, by providing a dual mode scrubber with a square cleaning pad that can rotate in a first mode to achieve the scrubbing operation away from the walls, and reciprocate longitudinally in a second mode adjacent to a wall to remove the sediment next to the wall.

Generally, the present invention accomplishes a dual mode operation having a first rotating mode and a second reciprocating mode using a "dog clutch" arrangement. In the rotating mode, the dog clutch is disengaged and a gear arrangement is engaged causing a lower portion to rotate. In the reciprocating mode, the gear arrangement is disengaged and the dog clutch engages a double throw crank shaft with attached dual linkage. One linkage arm is pivotably secured to the scrubber plate. A second linkage arm is pivotably secured to a counter weight assembly which dampens unwanted vibrations. It is to be understood that the terms buffer and scrubber can be used interchangeably herein while in the art the terms can refer to the polishing of a newly waxed floor and the removing of old wax or other sediment, respectively.

BRIEF DESCRIPTION OF THE DRAWINGS

FIG. 3 depicts a frontal, partial view of the various plates of one embodiment of the invention FIG. 4 depicts a bottom, partial view of the various plates of one embodiment of the invention

DETAILED DESCRIPTION

Figure 1:
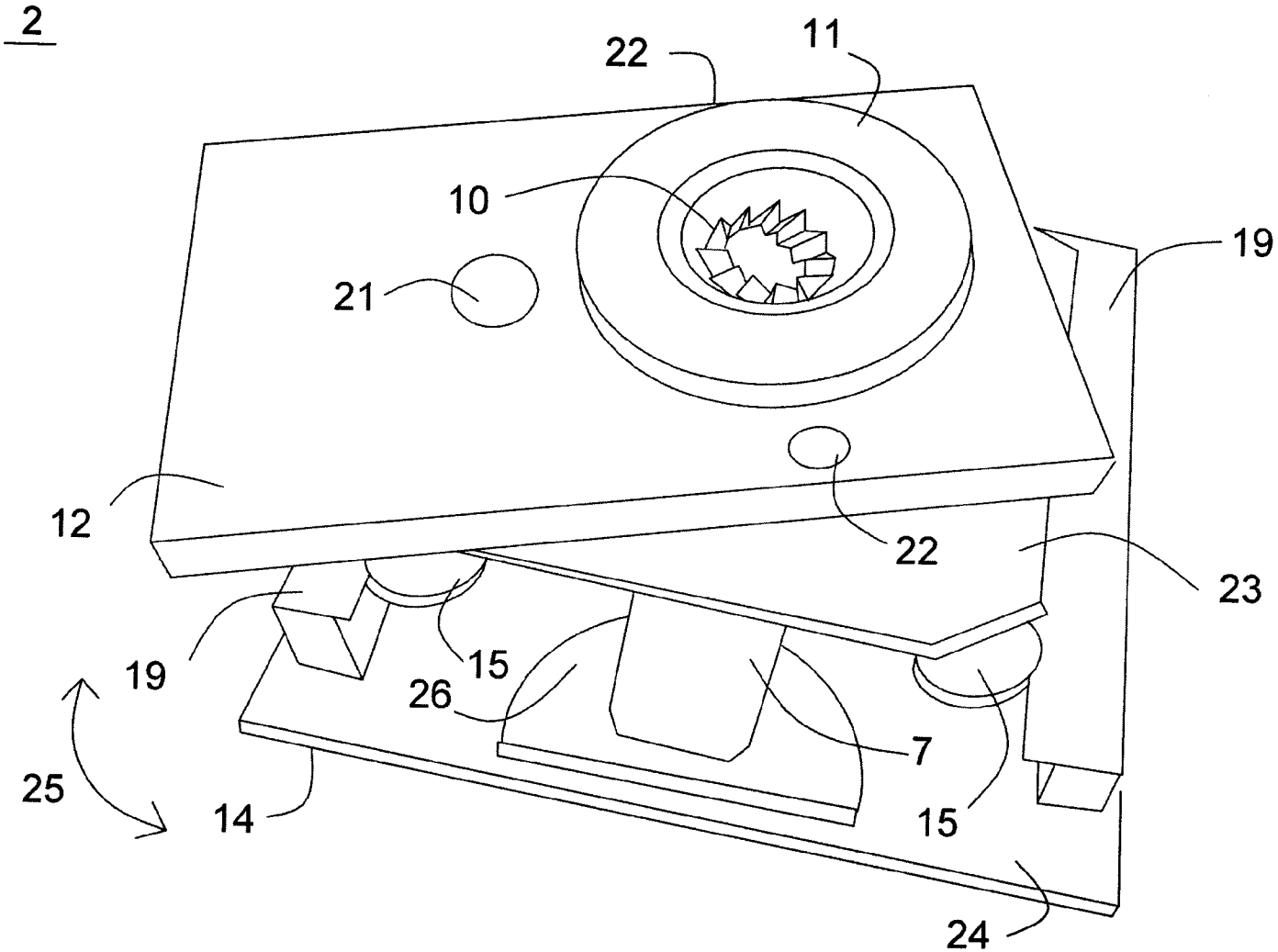
FIG. 1 depicts a perspective view of the lower assembly of one embodiment of the invention

One embodiment of a floor scrubber comprises: an upper assembly 1 comprising, a motor 100, a first plate 3 having a lower surface 30, a support plate 20, a first clutch member 34, a shaft 35, a first gear 37, a second gear 36, a third gear 38, a housing 39, a support plate 20, and a shroud 101; a lower assembly 2 comprising, a first linkage arm 62 having first and second ends 4,5, a square pad 6, a second linkage arm 17 having first and second ends 7,8, a fourth gear 11, a second clutch member 10, a second plate 12, a third plate 50 having two tapered edges 51 on opposite sides, a fourth plate 23, a fifth plate 14 having upper and lower surfaces 24,18, eight V-groove rollers 15, a double throw crank shaft 16 having first and second eccentric portions 60,61, two flanges 19 connected to upper surface 24 of fifth plate 14, a second hole 21 being displaced in second plate 12, a first ball bearing set 63, a second ball bearing set 64, a mounting plate 26, mating holes 22 displaced on opposite sides of each of plates 12 & 23, and further being adapted to coincide with locking pins 31, and a mounting plate 26; handle 102; and wheels 103.

Figure 2:
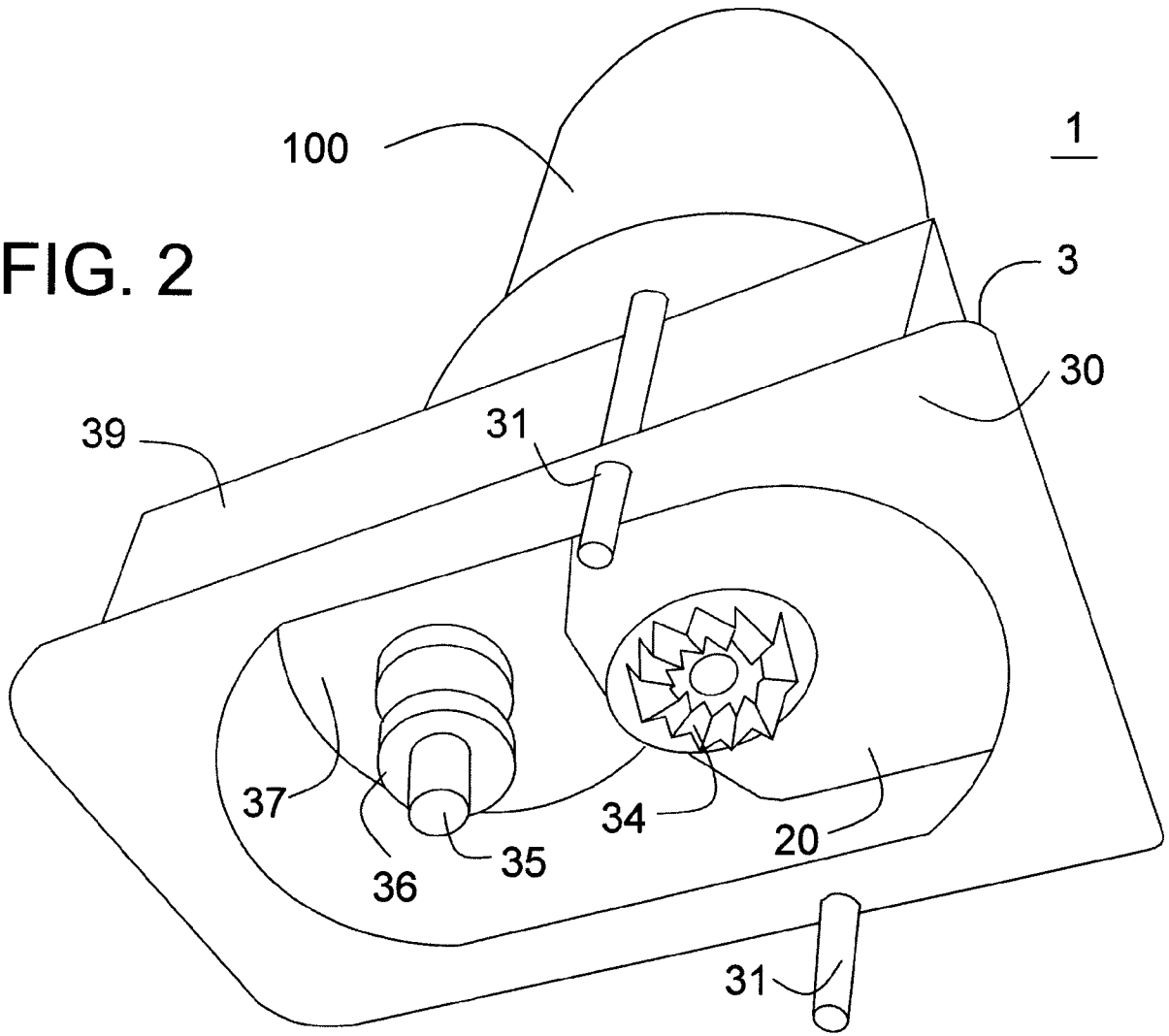
FIG. 2 depicts a perspective view of the upper assembly of one embodiment of the invention
Figure 6:
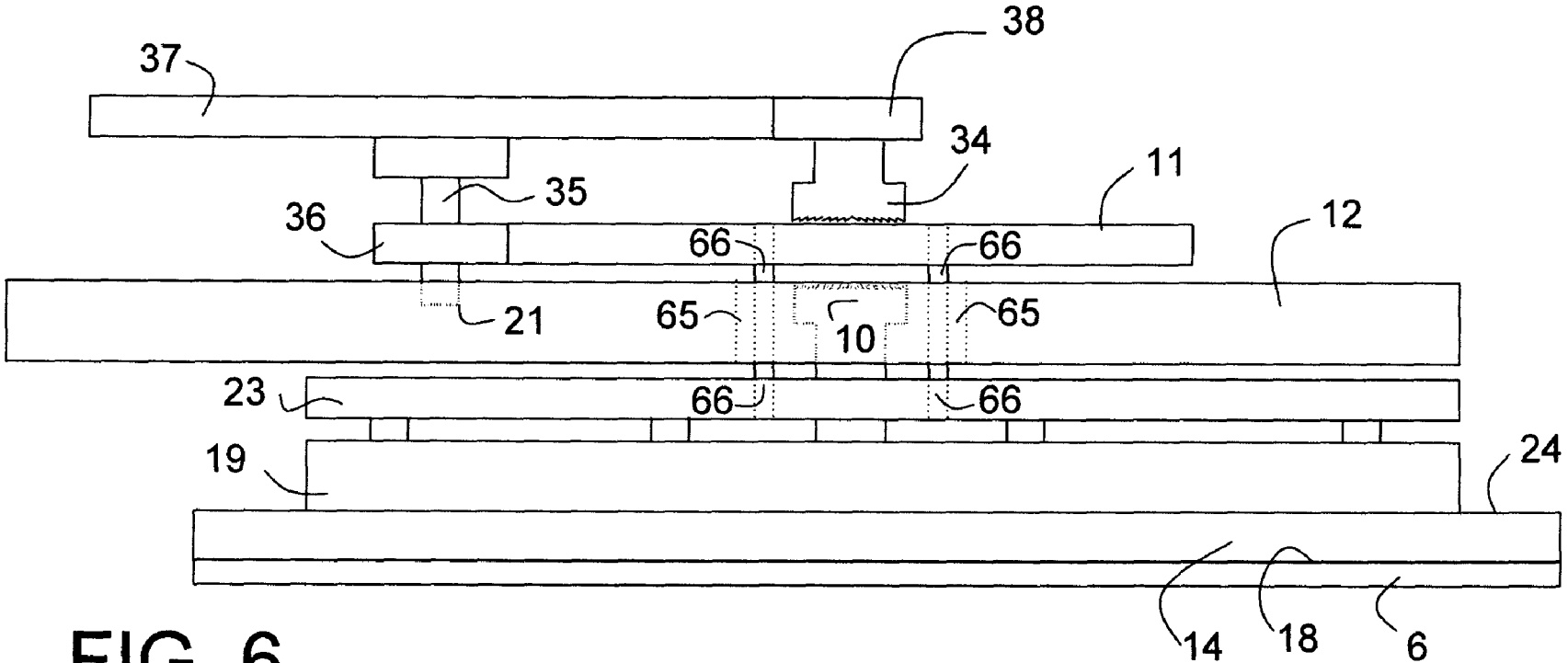
FIG. 6 depicts a side, partial view of the various plates and linkage arms of one embodiment of the invention in the rotating mode
Figure 7:
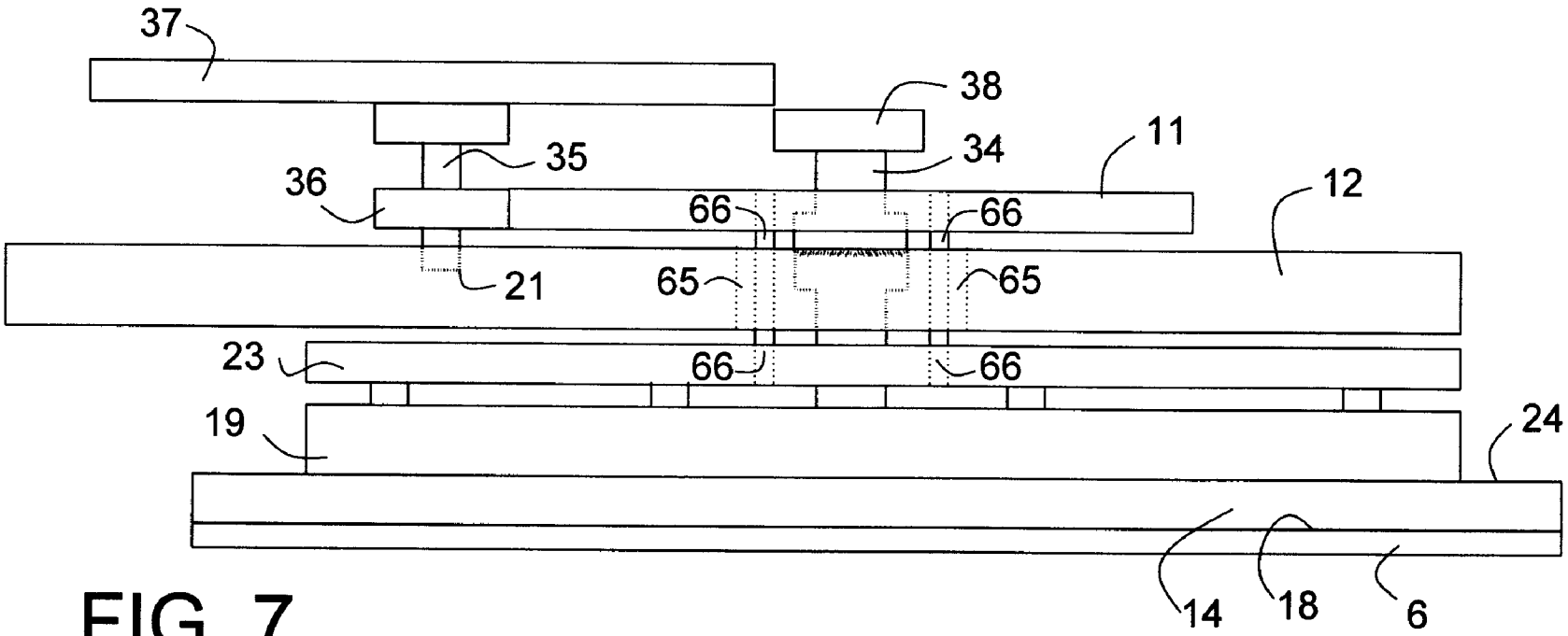
FIG. 7 depicts a side, partial view of the various plates and linkage arms of one embodiment of the invention in the reciprocating mode
Figure 8:
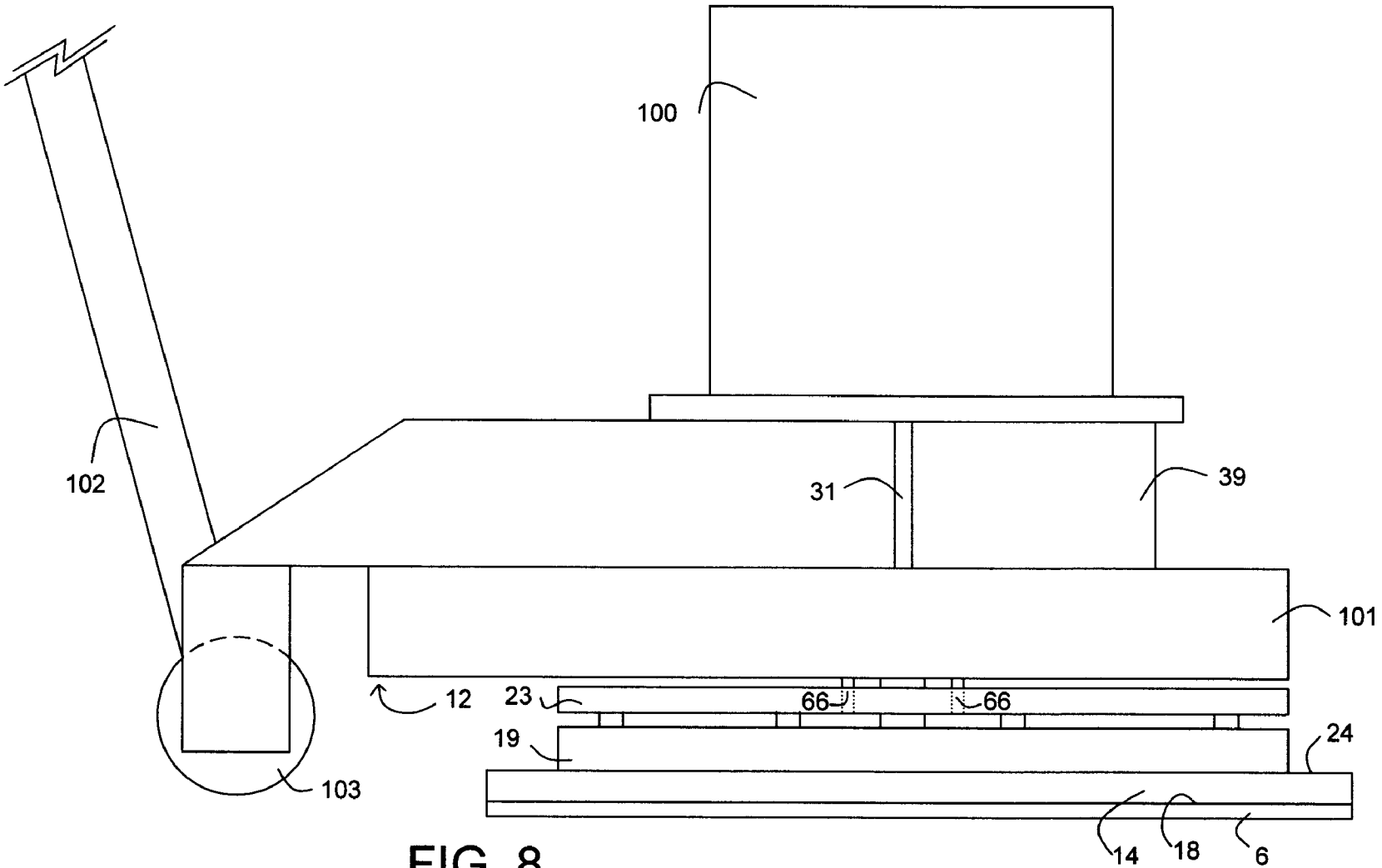
FIG. 8 depicts a side view of the invention (handle fragmented)

Upper assembly 2 (FIG. 2) is secured to lower assembly 1 (FIG. 1); surface 30 of first plate 3 is flush with the upper surface of plate 12 and secured by bolts. Shaft 35 fits within hole 21 and may freely rotate within it. Pins 31 go through mating holes 22 in plates 3, 12, and 23. Pins 31 slidingly engage holes 22 in fourth plate 23 in the reciprocating mode (thus locking plate 23 with plates 3 & 12) and are retracted (thus disengaging plate 23) in the rotating mode. Second plate 12 is attached to gear 11 by sleeve 66 (FIG. 6) which rotates freely within bearing set 65 which is retained in Plate 12 (FIG. 6) as depicted by direction arrows 25 in FIG. 1. Therefore, plates 14 and 23 in FIG. 1 and plate 50 in FIG. 3 may rotate with respect to the upper assembly in FIG. 2 in the rotating mode.

Plates 14, 23 & 50 can only move longitudinally with respect to each other. Therefore, if fifth plate 14 rotates, so will plates 14 & 50. This is achieved by disposing flanges 19 to upper surface 24 of fifth plate 14 on opposite sides thereof. Flanges 19 engage four V-groove rollers 15, two on either side of plate 23. The remaining four V-groove rollers are in contact with plate 50 (two on each side).

As shown in FIG. 4, each of the rollers 15 are connected to fourth plate 23 (four on either side). On each side of fourth plate 23, two rollers engage flanges 19 and the other two (inner most rollers) engage third plate 50. Third plate 50 has tapered edges 51, as do flanges 19. The tapered edges engage the V-grooves (FIG. 3) in rollers 15. The rollers are latitudinally adjustable to engage either flanges 19 or plate 50.

The four rollers that are in contact with flanges 19 are connected approximate each of the four corners of fourth plate 23. The remaining four rollers (in contact with third plate 50—two on either side) are connected to fourth plate 23 and situated inside of the rollers that are in contact with flanges 19. All of the rollers on either side of fourth plate 23 are coplanar with respect to each other (FIG. 3), yet staggered as viewed from top or bottom (FIG. 4). If fourth plate 23 rotates, plates 14 & 50 will also rotate.

In the rotating mode (FIG. 6), first clutch member 34 is retracted and disengaged from second clutch member 10. This is preferably achieved by using a cam assembly (not shown) to lift the motor assembly (including motor 100 having a shaft, third gear 38, locking pins 31, and first clutch member 34) upward thereby retracting first clutch member 34 and pins 31. A locking mechanism (not shown) serves to lock the motor assembly in place in the elevated position.

In this mode, first gear 37 is engaged to third gear 38 (which is coaxial and affixed to the motor shaft with the motor shaft) whereas in the second reciprocating mode it is not. First gear 37 is coaxial with second gear 36 and connected to it by shaft 35. Second gear 36 engages fourth gear 11. Fourth gear 11 is connected to sleeve 66 which is connected to fourth plate 23. Thus, fourth plate 23 rotates along with fourth gear 11. Thus, power is transferred from the motor shaft to third gear 38, then to first gear 37, then to second gear 36, then to fourth gear 11 which causes plates 14, 23, & 50 to rotate (plates 14 and 50 necessarily rotate along with fourth plate 23).

In the reciprocating mode, plates 50 and 14 reciprocate longitudinally and parallel with each other, but 180 degrees out of phase. To switch to the reciprocating mode, the locking mechanism is released and the cam assembly lowers the motor downwardly, to engage first and second clutch members 34 & 10. In this mode, first gear 37 is disengaged from third gear 38 (and thus from the motor shaft), so it does not rotate.

Figure 5:
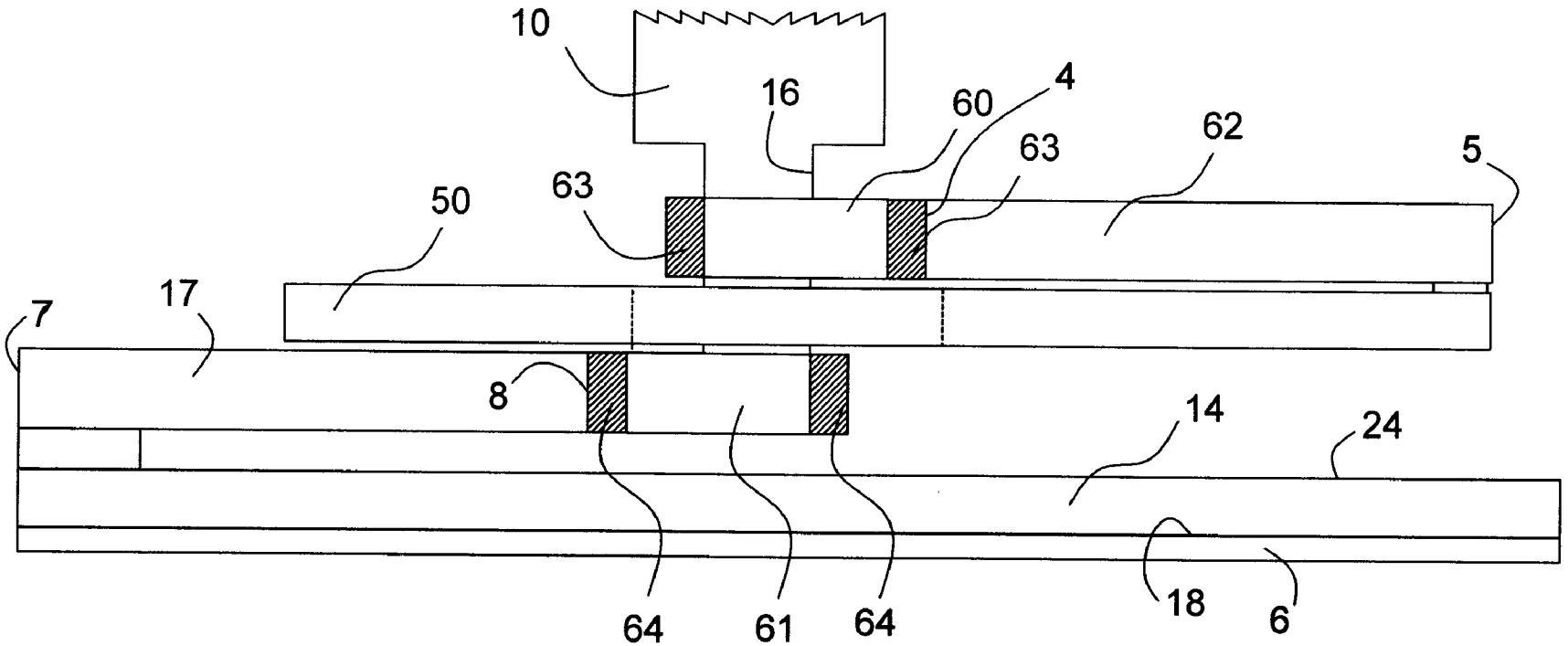
FIG. 5 depicts a side, partial view of the various plates and linkage arms of one embodiment of the invention

Second clutch member 10 is connected to a double throw crank shaft 16 with first and second linkage arms 62, 17 attached thereto. Double throw crank shaft 16 has first and second eccentric portions 60, 61 that are disposed 180 degrees out of phase with respect to each other (FIG. 5). First eccentric portion 60 is connected to first end 4 of first linkage arm 62 via first ball bearing set 63. Second end 5 of first linkage arm 62 is pivotably connected to third plate 50. Second eccentric portion 61 is connected to second end 8 of second linkage arm 17 via second ball bearing set 64. First end 7 of second linkage arm 17 is pivotably connected to mounting plate 26 which is attached to upper surface 24 of fifth plate 14.

Plate 50 serves as a counter weight. It reciprocates 180 degrees out of phase with respect to plate 14. This effectively dampens unwanted vibration. One of skill in the art will appreciate that the actual weight of third plate 50 (counter weight) can be chosen proportional to the actual weight of fifth plate 14 and the various components attached thereto and resistance of the surface being cleaned.

A square buffing or scrubbing pad 6 is secured to lower surface 18 of fifth plate 14 which either rotates or reciprocates. A distinct advantage is achieved, not only in having a dual mode machine, but also having a square pad that can clean next to walls and corners (in the reciprocating mode).

In one embodiment, shroud 101 is removably connected to first plate 3 so as to cover portions of upper and lower assemblies 1 & 2. In one embodiment, pins 31 are located outside of housing 39. However, pins 31 can also be within housing 39.

What is claimed is:

1. A dual mode floor cleaning apparatus comprising:

a motor operatively connected to a square pad switchable between a first rotating mode and a second reciprocating mode;

the motor being operatively connected to the square pad in the reciprocating mode by a clutch assembly;

the motor being operatively connected to the square pad in the rotating mode by a gear assembly.

2. A dual mode floor cleaning apparatus comprising:

a motor operatively connected to a square pad switchable between a first rotating mode and a second reciprocating mode;

the motor being operatively connected to the square pad in the reciprocating mode by a clutch assembly and double throw crank shaft, the double throw crank shaft having a first eccentric portion being operatively connected to a counter weight by a first dual arm linkage, and a second eccentric portion being 180 degrees out of phase with respect to the first eccentric portion and operatively connected to the square pad by a second dual arm linkage;

the motor being operatively connected to the square pad in the rotating mode by a gear assembly;

the gear assembly being disengaged in the reciprocating mode.

* * * * *